United States Patent [19]

Kajiya et al.

[11] 4,124,092

[45] Nov. 7, 1978

[54] MUFFLER FOR AUTOMOBILES

[75] Inventors: Sadao Kajiya; Tomiaki Atsumi; Osamu Kuroda; Tamio Nakakubo, all of Toyota, Japan

[73] Assignee: Toyota Jidosha Kogyo Kabushiki Kaisha, Toyota, Japan

[21] Appl. No.: 800,015

[22] Filed: May 24, 1977

[30] Foreign Application Priority Data

Feb. 21, 1977 [JP] Japan ..... 52/17884

[51] Int. Cl.[2] ..... F01N 1/00

[52] U.S. Cl. ..... 181/265; 181/272

[58] Field of Search ..... 181/265, 269, 272, 275, 181/268

[56] References Cited

U.S. PATENT DOCUMENTS

| | | | |
|---|---|---|---|
| 3,512,607 | 5/1970 | Hubbell | 181/265 |
| 3,724,591 | 4/1973 | Malkiewicz | 181/265 |

*Primary Examiner*—Donald G. Kelly

*Attorney, Agent, or Firm*—Stevens, Davis, Miller & Mosher

[57] ABSTRACT

A muffler for automobiles having a drum-shaped expansion chamber of diameter D and length *h,* to which gas inlet and outlet pipes and an insert pipe of a Helmholtz resonator open so that the gas flow traverses the expansion chamber substantially diametrically therethrough, wherein the ratio *h*/D is substantially 0.25 – 0.4.

7 Claims, 2 Drawing Figures

MUFFLER FOR AUTOMOBILES

BACKGROUND OF THE INVENTION

1. Field of the Invention

The present invention relates to a muffler for automobiles, and more particularly, an improvement of such a muffler with regard to the muffling performance thereof.

2. Description of the Prior Art

The exhaust system for an automobile engine incorporates therein a muffler for reducing the engine exhaust noise. As a type of the mufflers for this purpose, there is known a muffler which comprises an expansion chamber of a substantially drum-like shape having an equivalent diameter D and a length $h$, gas inlet and outlet pipes connected to said expansion chamber so as to cause a gas flow which traverses said expansion chamber substantially diametrically therethrough, and a low frequency resonator chamber axially connected to said expansion chamber, wherein said drum-shaped expansion chamber has a circular elliptical or a similar sectional shape. In the muffler of this type, the exhaust gas flow is applied expansion and contraction while it flows from the gas inlet pipe to the gas outlet pipe by traversing the expansion chamber substantially diametrically therethrough, thereby effecting a reduction of high to medium frequency noises, while on the other hand a low frequency noise included in the gas flow is reduced by the resonance effect applied by the resonator chamber.

The lower frequency resonator chamber is generally the Helmholtz resonator, which comprises a closed chamber and an insert pipe and is generally effective for reducing a low frequency noise having a frequency of 60–150 Hz which causes a humming noise in the passenger compartment. The resonant frequency of the Helmholtz resonator is given by the following well known formula:

$$f_r = (C/2\pi)\sqrt{(Co/V)} \quad (1)$$

wherein $f_r$ = resonant frequency $C$ = sound velocity $V$ = volume of the resonator chamber $Co$ = propagation constant Co is given by the following formula:

$$Co = \pi a^2/(l + \beta a) \quad (2)$$

wherein $a$ = radius of the insert pipe $l$ = length of the insert pipe $\beta$ = constant such as $(\pi/2) \sim (\pi/4)$ Since the low frequency resonator chamber effects reduction of noise by resonance, a good silencing effect is obtained when the velocity of the exhaust gas flow traversing the inlet portion of the insert pipe is judiciously designed in view of the resonance frequency of the resonator chamber while the impedance of the expansion chamber is designed to be sufficiently high relative to that of the resonator chamber. For the muffler of the abovementioned structure, the noise pressure reduction obtained by the low frequency resonator chamber is determined by the following formula:

$$Att \doteqdot 12 \log\left(1 + \frac{CoV}{(2ah)^2}\right) \quad (3)$$

wherein $Att$ = noise pressure reduction $h$ = length of the expansion chamber

Since the volume of the resonator chamber (V), the radius ($a$) and the propagation constant (Co) are determined in relation to the design resonant frequency of the low frequency resonator chamber, it is more desirable that the length ($h$) of the expansion chamber is smaller for obtaining a larger noise pressure reduction Att for a better silencing effect. In other words, when the length $h$ of the expansion chamber is made smaller, the impedance of the expansion chamber is increased so that the resonance effected by the low frequency resonator chamber is more activated thereby increasing the silencing effect.

However, when the length h of the expansion chamber is reduced, the back pressure for the engine increases, whereby there occurs various problems such as the reduction of the engine output power, the generation of the gas flow noise, the increase of a high frequency noise, etc.

SUMMARY OF THE INVENTION

As a result of various experimental research performed in consideration of the abovementioned matters, we have found that in order to obtain a good silencing effect by resonance, there exists a certain optimum range for the ratio of the length to the equivalent diameter of the expansion chamber of a drum-like shape incorporated in the muffler of the aforementioned type.

It is therefore the object of the present invention to provide a muffler for automobiles of the abovementioned type which incorporates a certain condition for optimizing the silencing performance thereof.

In accordance with the present invention, the abovementioned object is accomplished by providing a muffler for automobiles comprising an expansion chamber of a substantially drum-like shaft having an equivalent diameter D and a length $h$, gas inlet and outlet pipes connected to said expansion chamber so as to cause a gas flow which traverses said expansion chamber substantially diametrically therethrough, and a low frequency resonator chamber axially connected to said expansion chamber, wherein the ratio $h/D$ is substantially 0.25 to 0.4.

BRIEF DESCRIPTION OF THE DRAWING

The invention will be more fully understood by the following description made with reference to the accompanying drawings which are given for the purpose of illustration only and are not limitative of the invention and wherein.

DESCRIPTION OF THE PREFERRED EMBODIMENT

Figure 1:
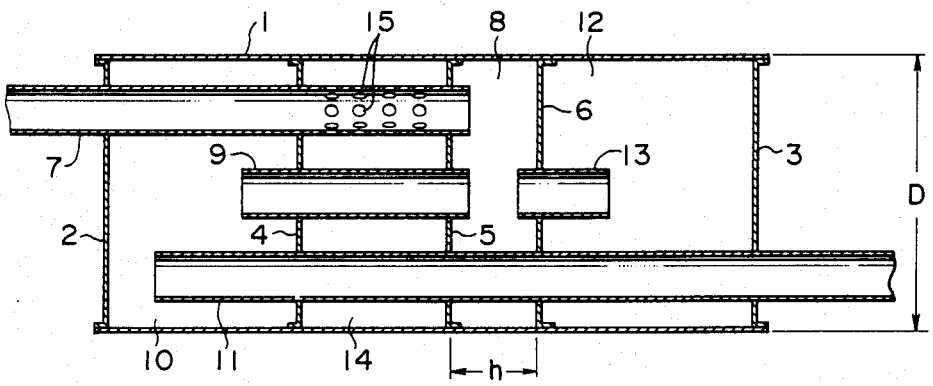
FIG. 1 is a sectional view showing an embodiment of the muffler of the present invention.

Referring to FIG. 1, 1 designates a cylindrical or tubular body having a substantially circular cross section and closed at opposite ends by end plates 2 and 3. The internal space of the closed cylindrical body is further separated into four chambers by three baffle plates 4,5 and 6. A gas inlet pipe 7 is provided in a manner such that it passes through the end plate 2 and baffle plates 4 and 5 and opens to an expansion chamber 8 defined by the cylindrical body 1 and the baffle plates 5 and 6. The gas inlet pipe 7 is connected to the exhaust manifold of the engine (not shown in the figure) and receives a flow of exhaust gas therefrom. The flow of exhaust gas delivered from the gas inlet pipe to the expansion chamber 8 traverses the expansion chamber substantially diametrically therethrough and then flows into a pipe 9 and is then delivered therefrom to a second expansion chamber 10. The gas flow is then introduced through gas outlet pipe 11 to be exhausted to the atmosphere. On the other side of the first expansion chamber 8 opposite to the pipe 9 or the second expansion chamber, is provided a low frequency resonator chamber 12 defined by the cylindrical body 1, the end plate 3 and the baffle plate 6. An insert pipe 13 is provided so as to penetrate the baffle plate 6 and to communicate the resonator chamber 12 to the expansion chamber 8, thereby providing a Helmholtz resonator. As shown in FIG. 1, the insert pipe 13 is diametrically offset relative to the gas inlet pipe 7, while the insert pipe 13 may preferably be aligned with the pipe 9. The gas inlet pipe 7 is formed with a plurality of small openings 15 which open towards another resonator chamber 14 defined by the cylindrical body 1 and the baffle plates 4 and 5.

In accordance with the present invention, the ratio of the length $h$ to the diameter D of the drum-shaped expansion chamber 8 is determined to be substantially in the range of 0.25–0.4. When the inner diameter of the cylindrical body 1 is 120–180 mm as in common mufflers for automobiles, the length $h$ of the expansion chamber 8 should preferably be 40 – 60 mm.

Figure 2:
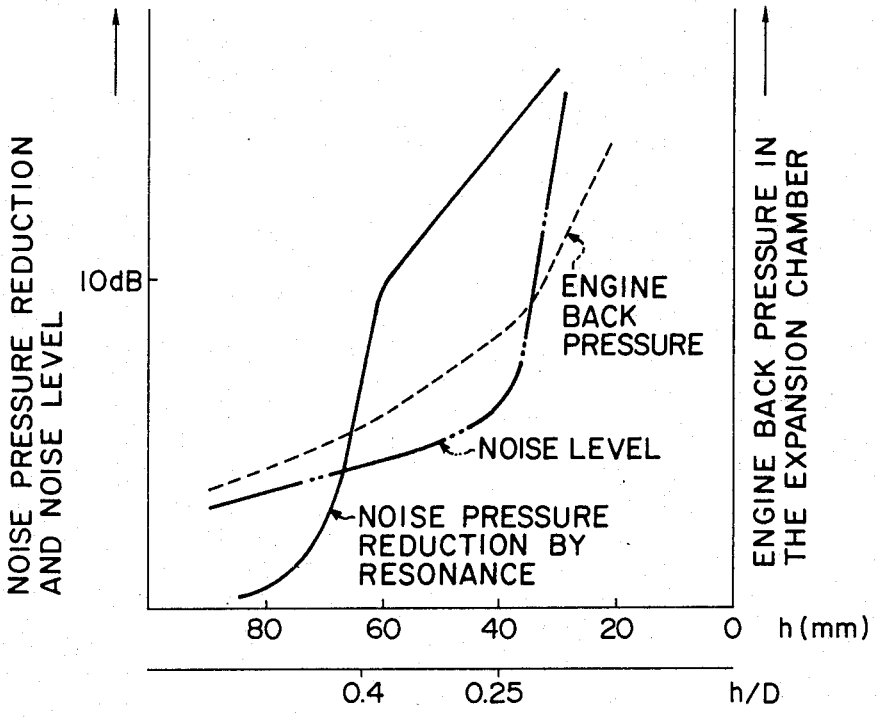
FIG. 2 is a graph showing the relation existing among the ratio of the length to the equivalent diameter of the expansion chamber, noise pressure reduction, noise level and engine back pressure.

As an example, several mufflers were prepared so that they had the cylindrical body inner diameter D of 160 mm and various resonant frequencies of the low frequency resonator chamber 12 ranging from 100 – 120 Hz. With respect to these mufflers, the length $h$ of the expansion chamber 8 was further gradually changed and they were tested to measure the noise pressure reduction by resonance, the high frequency noise level and the engine back pressure. The results of the tests are shown in FIG. 2 in accordance with average values. From this figure, it is understood that when the length $h$ of the expansion chamber is smaller than 40 mm, the high frequency noise level and the engine back pressure abruptly increase, whereas when the length $h$ is larger than 60 mm, the noise pressure reduction by resonance abruptly lowers. Therefore, the result shows that when the inner diameter D of the cylindrical body 1 is 160 mm, the length $h$ of the expansion chamber 8 should be in the range 40 – 60 mm. This condition corresponds to the ratio of $h/D$ of 0.25 – 0.4. When this condition is satisfied, a desirable noise pressure reduction by resonance is obtained while desirably suppressing the high frequency noise level and the back pressure.

The abovementioned condition that the ratio $h/D$ is to be substantially 0.25 – o.4 is applicable to mufflers having an elliptical or substantially circular cross section when D is substitued by the equivalent diameter of the cross section.

Although the invention has been shown and described with respect to a particular embodiment thereof, it is to be understood by those skilled in the art that various changes and/or omissions with respect to a part thereof can be made without departing from the scope of the invention.

We claim:

1. A muffler for automobiles comprising a tubular body having equivalent diameter D, two end plates and at least two baffle plates each traversing the internal space of said tubular body so as to define an expansion chamber having axial length $h$ and a low frequency resonator chamber therebetween, gas inlet and outlet pipes connected to said expansion chamber at transversely spaced positions so as to cause a transverse flow of gases through said expansion chamber, and an insert pipe which connects said expansion chamber and said low frequency resonator chamber, wherein ratio $h/D$ is substantially between 0.25 and 0.4.

2. The muffler of claim 1, wherein said gas inlet and outlet pipes are arranged axially on one side of said expansion chamber while said low frequency resonator chamber and said insert pipe are arranged on the other side of said expansion chamber.

3. The muffler of claim 2, wherein said low frequency resonator chamber comprises an insert pipe which connects said resonator chamber to said expansion chamber, said insert pipe being offset from the gas inlet pipe.

4. The muffler of claim 2, wherein said insert pipe axially opposes said gas outlet pipe.

5. A muffler for an automobile comprising:

(a) a cylindrical body having an axial length greater than its diameter D, two end plates, an inlet pipe and an outlet pipe diametrically offset from each other and projecting from opposite end plates;

(b) three baffle plates within the body defining four axially adjacent chambers comprising a first resonator chamber, a first expansion chamber, a second resonator chamber and a second expansion chamber, said first expansion chamber having an axial length $h$ wherein the ratio $h/D$ is substantially between 0.25 and 0.4;

(c) said inlet pipe passing completely through said second expansion chamber and terminating in said first expansion chamber, a pipe diametrically offset from said inlet pipe communicating said first expansion chamber with said second expansion chamber so that there is transverse gas flow through said first expansion chamber;

(d) said outlet pipe passing completely through said first resonator chamber and said first expansion chamber and terminating in said second expansion chamber;

(e) an opening between said first expansion and first resonator chambers.

6. The muffler of claim 5 in which the opening between the first expansion and first resonator chambers is in substantial axial alignment with the pipe connecting the first and second expansion chambers.

7. The muffler of claim 5 in which the inlet pipe has a plurality of openings in its side which communicate with the second resonator chamber.

* * * * *